United States Patent [19]

Hotten et al.

[11] 4,032,462

[45] June 28, 1977

[54] LUBRICATING OIL ADDITIVE COMPOSITION

[75] Inventors: Bruce W. Hotten, Orinda; John M. King, San Rafael, both of Calif.

[73] Assignee: Chevron Research Company, San Francisco, Calif.

[22] Filed: May 24, 1976

[21] Appl. No.: 689,615

[52] U.S. Cl. ..... 252/49.7; 252/46.4

[51] Int. Cl.[2] ..... C10M 1/38; C10M 1/54

[58] Field of Search ..... 252/49.7, 46.4

[56] References Cited

UNITED STATES PATENTS

| | | | |
|---|---|---|---|
| 2,160,911 | 9/1934 | Russell | 252/49.7 |
| 3,274,107 | 9/1966 | Wilson et al. | 252/46.4 |
| 3,274,258 | 9/1966 | Odenweller | 252/46.4 |

*Primary Examiner*—Delbert E. Gantz
*Assistant Examiner*—J. Thierstein
*Attorney, Agent, or Firm*—D. A. Newell; C. J. Tonkin

[57] ABSTRACT

A lubricating oil additive composition which imparts improved oxidation properties, particularly for crankcase lubricants, comprises an antioxidant selected from sterically hindered phenols or thiophenols, or aromatic amines, and mixtures thereof, and an oil-soluble antimony compound of the formula $$(R)_3Sb \text{ or } (R)_3Sb \rightarrow X$$

wherein each R is independently hydrocarbyl and X is oxygen or sulfur. Lubricating oil compositions containing this additive composition are also disclosed.

10 Claims, No Drawings

LUBRICATING OIL ADDITIVE COMPOSITION

BACKGROUND OF THE INVENTION

This invention relates to an improved lubricating composition, and more particularly, this invention relates to a lubricating composition containing an additive combination having improved antioxidation properties.

Hydrocarbon oils are partially oxidized when contacted with oxygen at elevated temperatures for long periods. The internal combustion engine is a model oxidator, since it contacts a hydrocarbon motor oil with air under agitation at high temperatures. Also, many of the metals (iron, copper, lead, nickel, etc.) used in the manufacture of the engine and in contact with both the oil and air, are effective oxidation catalysts which increase the rate of oxidation. The oxidation in motor oils is particularly acute in the modern internal combustion engine which is designed to operate under heavy work loads and at elevated temperatures.

The oxidation process produces acidic bodies within the motor oil which are corrosive to typical copper, lead, and cadmium engine bearings. It has also been discovered that the oxidation products contribute to piston ring sticking, the formation of sludges within the motor oil and an overall breakdown of viscosity characteristics of the lubricant.

Several effective oxidation inhibitors have been developed and are used in almost all of the conventional motor oils today. Typical of these inhibitors are zinc dithiophosphates and the oil-soluble phenolic and aromatic amine antioxidants. These inhibitors while exhibiting good antioxidant properties, are burdened by economic and oil contamination problems. A need, therefore, exists for an improved antioxidant that is stable at elevated temperatures, that can be employed in reduced concentrations, and that is economical and easy to produce.

It is an object of this invention to provide additive compositions for crankcase lubricating oils which impart improved antioxidant properties. It is a further object of this invention to provide a synergistic additive composition having antioxidant properties in lubricating oil compositions.

SUMMARY OF THE INVENTION

A lubricating oil additive composition which imparts improved oxidation properties to lubricants comprises an antioxidant selected from oil-soluble, sterically hindered phenols or thiophenols or aromatic amines and mixtures thereof, and an oil-soluble antimony compound of the formula $$(R)_3Sb \text{ or } (R)_3Sb \rightarrow X$$

wherein each R is independently hydrocarbyl and X is oxygen or sulfur.

The lubricating oil compositions of this invention comprise an oil of lubricating viscosity and an antioxidant amount of the composition described above, i.e., an antioxidant selected from oil-soluble, sterically hindered phenols or thiophenols or aromatic amines and mixtures thereof, and an oil-soluble antimony compound of the formula $$(R)_3Sb \text{ or } (R)_3Sb \rightarrow X$$

wherein each R is independently hydrocarbyl and X is oxygen or sulfur.

The antioxidant defined above in combination with the antimony compound as described above complement each other in a synergistic manner and form a combination having antioxidant properties superior to either additive alone. When the additive composition of this invention is added to a lubricating oil, less antioxidant is needed to control oxidation than when the antimony compound compound is not present.

DETAILED DESCRIPTION OF THE INVENTION

The compositions of this invention are highly stable additives for crankcase lubricating oils and impart excellent antioxidant properties to these oils.

The lubricant compositions of the invention contain a lubricating oil and the antioxidant additive composition as described above.

In a preferred embodiment of the lubricating oil composition, the conventional antioxidant is present in the amount of from 0.25 to 10 wight percent and the antimony compound is present in the amount of 0.001 to 5 weight percent. The weight ratio of the antioxidant to the antimony compound is ordinarily in the range of 1 to 0.001–21.

More preferably, the antioxidant is present in the lubricating oil in the amount of 0.25 to about 2 weight percent, and the antimony compound compound is present in the amount of 0.01 to 0.3, preferably 0.05 to 0.3 weight percent.

Antioxidant Component

The class of oil-soluble antioxidants which may be employed in the practice of this invention includes sterically hindered phenols and thiophenols, and aromatic amines, and mixtures of these antioxidants.

Included within the definition of phenolic and thiophenolic antioxidants are sterically hindered phenolics such as hindered phenols and bis-phenols, hindered 4,4′-thiobisphenols, hindered 4-hydroxy- and 4-thiolbenzoic acid esters and dithio esters, and hindered bis(4-hydroxy- and 4-thiolbenzoic acid and dithio acid) alkylene esters. The sterically hindered phenols and benzoic acid esters are the preferred phenolic antioxidants.

The sterically hindered phenolics have the basic groups:

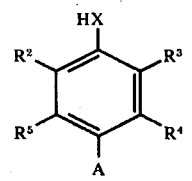

wherein: X is sulfur or oxygen and preferably oxygen; $R^2$ and $R^3$ are alkyl groups which sterically hinder the HX group and preferably have from 3 to 10 carbons and are usually branchedchain; $R^4$ and $R^5$ are the same or different substitutents selected from hydrogen or a $C_1$–$C_4$ alkyl and preferably hydrogen; and A is defined below.

The phenolic moiety is substituted in both positions ortho to the hydroxy or thiol groups with alkyl groups which sterically hinder these groups. Such alkyl substituents usually have 3 to 10 carbons, preferably 4 to 8 carbons, one generally branched rather than straight-chain, e.g., t-butyl, t-amyl, and the like.

The first group of hindered phenolic antioxidants comprises the hindered phenols where A in the above formula is hydrogen of a $C_1$ to $C_{10}$ alkyl group. Examples of such compounds include 2,6-di-t-butylphenol, 2,6-di-t-butyl-p-cresol, 2,6-di-t-amyl-p-cresol; and 2-t-butyl-6-t-amyl-p-cresol. Trialkylated monohydroxy phenols which may be employed herein are disclosed in U.S. Pat. No. 2,265,582.

A second group of hindered phenolic antioxidants is the hindered bis-phenols. In this case, A is a bond to another basic phenolic group, preferably through an intervening $C_1$ to $C_4$ alkylene group. Examples of these compounds include 4,4'-methylene bis (2,6-di-t-butyl phenol), 4,4'-dimethylene bis (2,6-di-t-butyl phenol), 4,4'-trimethylene bis (2,2-di-t-amyl phenol), and 4,4'-trimethylene bis (2,6-di-t-butyl phenol).

Another group of hindered phenolic antioxidants comprises the hindered 4,4'-thio bis-phenols, i.e., where A in the formula is -S or -S-S- connected to another phenolic group. Examples of these compounds include 4,4'-thio bis (2,6-di-t-butyl phenol), 4,4'-thio bis(2,6-di-sec-butyl phenol), 4,4'-thio bis(2-t-butyl-6-isopropyl phenol), 4,4'-thio bis(2-methyl-6-t-butyl phenol, etc. These compounds and their preparations are described in detail in U.S. Pat. No. 3,326,800, which is herein incorporated by reference.

A fourth group of hindered phenolic antioxidants comprises 4-hydroxy- and 4-thiolbenzoic monothio or dithiobenzoic acid esters, i.e., A in the above formula is a $C_2$–$C_{21}$ ester or a dithio ester group. Exemplary compounds of this group include 3,5-di-t-butyl-4-hydroxy benzoic acid methyl ester, 3,5-di-t-butyl-4-hydroxy dithiobenzoic acid methyl ester, 3,5-di-t-butyl-4-hydroxybenzoic acid n-octyl ester, 3,5-di-t-butyl-4-hydroxy dithiobenzoic acid n-octyl ester, and 3,5-di-t-butyl-4-hydroxy dithiobenzoic acid benzyl ester, 3,5-di-t-butyl-4-hydroxy dithiobenzoic acid hydroxypropylene oxypropylene ester.

Another group of hindered phenolic antioxidants comprises bis(4-hydroxy- or 4-thiolbenzoic acid or dithiobenzoic acid) alkylene esters, i.e., A in the above formula is a $C_2$–$C_{21}$ di-ester or dithio ester connected through an alkylene linkage to another phenolic group. Exemplary compounds of this type include bis(3,5-di-t-butyl-4-hydroxy dithiobenzoic acid) methylene ester, bis(3,5-di-t-butyl-4-hydroxydithiobenzoic acid) ethylene ester, etc. The preparation of these compounds is the same as set forth above, except that the monohalo hydrocarbon is replaced with a dihalohydrocarbon.

Included within the definition of oil-soluble aromatic amine antioxidants are amino phenols, naphthyl-phenyl amines, phenyl alkyl amines, etc. The preferred aromatic amines have the basic group:

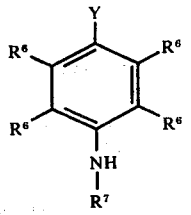

wherein Y is the same or different substitutent selected from OH, SH, H, R, $NHR^6$ or $NHR^7$; $R^6$ is the same or different sub-substituent selected from H, or a $C_1$ to $C_4$ alkyl; and $R^7$ is a $C_1$ to $C_{18}$ alkyl.

Examples of aromatic amine antioxidants included within the above formula include the hydroxyl and thiol amines, such as N-n-butyl-p-amino phenol, N-ethyl-sec-butyl-p-amino phenol, N-n-butyl-p-amino thiophenol, N-n-butyl-p-amino-2-methylphenol, the phenylene diamines such as N,N'-di-sec-butyl-phenylene diamine, N,N'-bis(1,4-dimethylpentyl)-p-phenylene diamine, N,N'-diphenyl-p-phenylene diamine, N,N'-di-p-naphthyl-p-phenylene diamine, N,N'-methyl-ethyl-p-phenylene diamine, N,N'-di-n-butyl-p-phenylene diamine, etc., the naphthylamines such as N-phenyl-alpha-naphthylamine, N-phenyl-beta-napthylamine, N-p-methylphenyl-alpha-naphthylamine, etc., and the diphenylamines such as di-sec-butyldiphenylamine, dibornyl-diphenylamine, and dioctyldiphenylamine.

These antioxidants can be prepared by known processes and many of them are commercially available. Because these processes are well known in the art, a description thereof is not necessary.

The Antimony-Containing Compounds

The second component of the synergistic antioxidant composition is an oil-soluble antimony compound of the formula $$(R)_3Sb \text{ or } (R)_3Sb \rightarrow X$$

wherein R is hydrocarbyl and X is oxygen or sulfur. By "hydrocarbyl" in the above definition is intended any aromatic or aliphatic group consisting essentially of carbon and hydrogen atoms.

Preferred antimony compounds are those where R is $C_1$–$C_{30}$ alkyl or aryl. Most preferred are those compounds where R is $C_1$–$C_{20}$ alkyl, phenyl, or phenyl substituted by 1 to 2 $C_1$–$C_{12}$ alkyl groups and X, if present, is sulfur.

By "aryl" in the above definition is meant an aromatic hydrocarbon group containing one or two optionally fused aromatic rings which may be substituted by one or more $C_1$–$C_{12}$ alkyl groups. Typical aryl radicals are phenyl, naphthyl, biphenyl, xylyl, cresyl, tetrapropenyl phenyl, octyl phenyl, and the like.

The antimony compounds of the invention are prepared by conventional methods such as those described in Doak and Freedman, *Organometallic Compounds of Arsenic, Antimony, and Bismuth*, Wiley, 1970.

The lubricating oil composition is prepared by admixing, using conventional mixing techniques, the desired amount of antioxidant and antimony compound compound within a suitable lubricating oil. The selection of the particular base oil and antimony compound compound, as well as the amounts and ratios of each, depends upon the contemplated application of the lubricant and the presence of other additives. Generally, however, the amount of oil-soluble antioxidant employed in the lubricating oil will vary from 0.25 to 10, and usually from 0.25 to 2, weight percent in most applications. The antimony compound compound will range from 0.01 to 2, and usually from 0.01 to 0.3, preferably from 0.05 to 0.3, weight percent based on the weight of the final composition. The weight ratio of organic oil-soluble antioxidant to antimony compound will generally vary from 5–20 to 1, and usually from 10–20 to 1.

The lubricating oil which may be employed in the practice of this invention includes a wide variety of hydrocarbon oils such as naphthenic base, paraffin base, and mixed base oils. Other oils include lubricating oils derived from coal products and synthetic oils, e.g., alkylene polymers (such as propylene, butylene, and so forth, and mixtures thereof), alkylene oxidetype polymers (e.g. alkylene oxide polymers prepared by polymerizing alkylene oxides, such as ethylene oxide, propylene oxide, etc. in the presence of water or alcohol, e.g. ethyl alcohol), carboxylic acid esters (e.g. those which are prepared by esterifying carboxylic acids, such as adipic acid, azelaic acid, suberic acid, sebacic acid, alkenylsuccinic acid, fumaric acid, maleic and so forth, with an alcohol such as butyl alcohol, hexyl alcohol, 2-ethylhexyl alcohol, pentaerythritol and so forth, liquid esters of phosphorus, such as trialkyl phosphate (triscresyl phosphate), etc., alkylbenzenes, polyphenyls (e.g. biphenyls and terphenyls), alkylbiphenyl ethers, esters and polymers of silicon, e.g. tetraethyl silicate, tetraisopropyl silicate, hexyl(4-methyl-2-pentoxy) disilicate, poly(methyl)siloxane, and poly(methylphenylsiloxane), and so forth. The lubricating oils may be used individually or in combinations whenever miscible, or whenever made so by use of mutual solvents. The lubricating oils generally have a viscosity which ranges from 50 to 5,000 SUS (Saybold Universal Seconds), and usually from 100 to 1,500 SUS at 100° F.

In addition to the antioxidant and the antimony compound, other additives may be successfully employed within the lubricating composition of this invention without affecting its high stability and performance over a wide temperature scale. One type of additive which may be employed is a rust inhibitor. The rust inhibitor is employed in all types of lubricants to suppress the formation of rust on the surface of metallic parts. Exemplary rust inhibitors include sodium nitrate, alkenyl succinic acid and derivatives thereof, alkylthioacetic acid and derivatives thereof, polyglycols and derivatives thereof, alkoxylated amines and derivatives thereof, and so forth. Another type of lubricating additive which may be employed in the compositions of this invention comprises ashless dispersants and detergents. Typical compositions included within this class are the conventional succinimides, succinates, hydrocarbylalkylene polyamines, alkaline earth metal salts of alkylaryl sulfonates, phenates and the like. Still other additives which may be included in the lubricating oil compositions are zinc salts, especially the zinc dihydrocarbyl dithiophosphates, such as the dialkyl dithiophosphates.

Concentrates of the additive composition of this invention with lubricating oil may be prepared for improved handling and to reduce storage costs. The concentrates usually contain from 10–90%, preferably 20–80%, of the additive composition of this invention admixed with diluent oil, especially lubricating oil. This concentrate is diluted with additional lubricating oil to form a finished lubricating oil composition.

Other types of lubricating oil additives which may be employed in the practice of this invention include antifoam agents, (e.g. silicones, organic copolymers), stabilizers and antistain agents, tackiness agents, antichatter agents, dropping point improvers and antisquawk agents, lubricant color correctors, extreme pressure agents, odor control agents, detergents, antiwear agents, thickeners, and so forth.

LUBRICANT PERFORMANCE

The presence of the antimony compound within the lubricant composition promotes the antioxidation properties of the oil-soluble antioxidant used therewith. With this combination, less of the antioxidant is necessary in the lubricant formulation in order to achieve the desired antioxidation properties.

The following example is presented to illustrate the practice of specific embodiments of this invention and should not be interpreted as a limitation on the scope of this invention.

EXAMPLE 1

This example illustrates the effectiveness of the combination of the antimony compounds with this antioxidant in improving the antioxidation properties of a lubricating oil over the use of either of the components individually. The oxidation test employed herein measures the resistance of the test sample to oxidation using pure oxygen with a Dornte-type oxygen absorption apparatus (R. W. Dornte, "Oxidation of White Oils," Industrial and Engineering Chemistry, Vol. 28, page 26, 1936). The conditions are: an atmosphere of pure oxygen exposed to the test oil, the oil maintained at a temperature of 340° F, and as the oxidation catalyst, 0.69% Cu, 0.41% Fe, 8.0% Pb, 0.35% Mn, and 0.36% Sn (as naphthenates) in the oil. The time required for 100 q of the test sample to absorb 1000 ml of oxygen is measured. The lubricating oil base is mid-continent 480 neutral oil. Table I below reports the reference values in hours for the oil alone and for the conventional antioxidant in oil.

TABLE I

| Sample Tested | Oxidation Life, Hrs. |
|---|---|
| 1. 480 SSU (38° C.) paraffinic oil | 0.5 |
| 2. 480 SSU (38° C.) paraffinic oil 2% Di-t-butyl-p-cresol | 2.6 |
| 3. 480 SSU (38° C.) paraffinic oil 2% dibornyl diphenylamine | 3.7 |

Table II reports the oxidation life in hours of the composition being tested. The percent increase in oxidation life for the composition is also reported. This increase was computed as follows (where I=inhibition time)

$$\% \text{ increase} = \frac{100(I_{test\ sample} - I_{base\ oil})}{I_{antioxidant\ alone} - I_{base\ oil}} - 100$$

TABLE II

| Antimony Compound | 2%[1] hrs. | 2%[1] % | 2%[2] hrs. | 2%[2] % | No Antioxidant hrs. |
|---|---|---|---|---|---|
| 6 mmols/kg $(butyl)_3Sb$ | 7.0 | 220 | 10 | 200 | 0.6 |
| 6 mmols/kg $(phenyl)_3Sb$ | 6.5 | 190 | 8.3 | 140 | 0.65 |
| 6 mmols/kg $(phenyl)_3Sb$->S | 13 | 510 | 15 | 340 | 0.9 |

[1]di-t-butyl-p-cresol
[2]dibornyl diphenylamine

What is claimed is:

1. An additive composition for use in lubricating oils comprising:

1. an oil-soluble antioxidant selected from sterically hindered phenols and thiophenols, aromatic amines and
2. an oil-soluble antimony compound of the formula $$(R)_3Sb \text{ or } (R)_3Sb \rightarrow X$$

wherein each R is independently hydrocarbyl and X is oxygen or sulfur.

2. The composition of claim 1 wherein the weight ratio of the antioxidant to the antimony compound is 1:0.001–21.

3. The composition of claim 2 wherein R is alkyl or aryl and the antioxidant is a hindered phenol, a dialkyl diphenyl amine or mixtures thereof.

4. The composition of claim 3 wherein R is $C_1$–$C_{20}$ alkyl, phenyl or phenyl substituted by one or two $C_1$–$C_{12}$ alkyl groups.

5. The compositions of claim 4 wherein the antioxidant is di-t-butyl-p-cresol, or dibornyl diphenylamine and the antimony compound is $(phenyl)_3Sb$ or $(phenyl)_3Sb \rightarrow S$.

6. A lubricating oil composition comprising an oil of lubricating viscosity and an antioxidant amount of the composition of claim 1.

7. A method for preparing a lubricating oil composition which comprises mixing an oil of lubricating viscosity with the composition of claim 1.

8. A method of inhibiting the oxidation of a lubricating oil which comprises adding to the oil an effective amount of the composition of claim 1.

9. A lubricating oil concentrate which comprises from 10–90% of an oil of lubricating viscosity and from 90–10% of the composition of claim 1.

10. A lubricating oil composition comprising an oil of lubricating viscosity and an antioxidant amount of the composition of claim 5.

* * * * *